US005486004A

United States Patent [19]

Fogarty

[11] Patent Number: 5,486,004

[45] Date of Patent: Jan. 23, 1996

[54] RELEVANT CHESS PIECES

[76] Inventor: Charles P. Fogarty, P.O. Box 254, Commack, N.Y. 11725

[21] Appl. No.: 209,422

[22] Filed: Mar. 10, 1994

Related U.S. Application Data

[63] Continuation-in-part of Ser. No. 867,272, Apr. 8, 1992, abandoned, which is a continuation-in-part of Ser. No. 607,803, Nov. 1, 1990, abandoned.

[51] Int. Cl.[6] ..... A63F 3/02

[52] U.S. Cl. ..... 273/260; 273/288; D21/52

[58] Field of Search ..... 273/260, 288; D21/52

[56] References Cited

U.S. PATENT DOCUMENTS

| | | | |
|---|---|---|---|
| D. 204,142 | 3/1966 | Kidder | D34/5 |
| D. 217,479 | 5/1970 | Odette | D34/5 |
| 3,608,904 | 9/1971 | Margetson | 273/137 R |
| 3,677,550 | 7/1972 | Mathers | 273/137 R |
| 3,856,309 | 12/1974 | Helfgott | 273/137 R |
| 3,947,040 | 3/1976 | Samuels | 273/137 R |
| 4,015,849 | 4/1977 | MacLean | 273/260 X |
| 4,541,633 | 9/1985 | Newbill | 273/260 X |
| 4,553,756 | 11/1985 | Linnekin | 273/261 |
| 4,984,808 | 1/1991 | Young | 273/260 X |

FOREIGN PATENT DOCUMENTS

| | | | |
|---|---|---|---|
| 1276868 | 6/1972 | United Kingdom | A63F 2/02 |

*Primary Examiner*—William E. Stoll

*Attorney, Agent, or Firm*—Nolte, Nolte and Hunter

[57] ABSTRACT

A chess set in which each statuesque chess piece is respectively structured to be authentically relevant to the entitle directional mobility permitted the piece. Precise angular position of indicators radially diverging about a horizontal axis and structurally aligned in a vertical plane prominently project at respective angles to indicate the corresponding relevant angular rows and columns of a chess board along which the piece is entitled to linearly move from its present position.

8 Claims, 3 Drawing Sheets

RELEVANT CHESS PIECES

This is a continuation-in-part of application Ser. No. 07/867,272, filed Apr. 8, 1992, now abandoned which is a continuation-in-part of application Ser. No. 07/607,803, filed Nov. 1, 1990, now abandoned.

BACKGROUND OF THE INVENTION

Chess is an ancient game of skill that has become internationally standardized with the exception of the chess pieces. The designs of chess pieces are, therefore, variable and independently developed to appeal to the cultural preferences of various markets. The most popular are tribute to figures representative of historical eras. This historical theme is apparent to the Staunton chess set that is traditionally used in many chess tournaments. Said tradition, however, was circumstantially initiated, accordingly the Staunton design was not selected because it was particularly attractive, internationally appropriate or significantly relevant to the game of chess. The first international tournament was organized and held in England. The invited participants would naturally be distracted and confused if a variety of chess sets were permitted, and so the English Staunton chess set was thus elected to be exclusively used to play the middle eastern game of chess, in an international tournament. This choice, however, was not made to everyone's satisfaction nor did it appeal to thousands of casual chess players, who were free to choose their own chess sets, and still do to date. Thus, the lack of a universally acceptable chess set, thus encourages the production of a wide variety of chess sets that perpetuates the distraction and confusion for players using unfamiliar chess pieces and creates a particular hardship for novices attempting to learn the game of chess with any of the irrelevantly symbolic and/or hydrogenous chess sets that have been developed to date.

1. Field of the Invention

As the passing millenniums have failed to relieve the repetitious hardships by providing a universally relevant chess set, an endless array of representative cultural, political and military themes have filled the void and compound the confusion whereby any subject is now considered as being appropriate. In fact, however, themes representative of any subject other than chess itself are actually irrelevant fragments of the ancient history of chess. It is, therefore, the objective of the present invention to overcome the cited disadvantages by successfully providing a chess set that is universally appropriate, impartially prestigious, authentically relevant and an obvious tribute to the enduring history of the game of chess itself. This criteria is achieved by providing a method of structuring chess pieces to functionally embody the classic radial symmetry linearly formed by the genuine distinctive moves of the respective chess pieces, to thus form chess pieces as regal scepters proclaiming their definitively entitled directional mobility, as eminently displayed, to authentically indicate their respectively relevant directional mobility, as is conformingly permitted on the correspondingly defined vertical, horizontal and diagonal rows of a chess board. These scepter-like configurations thus retain the established appeal of historical themes by personifying the regal authority of their traditionally associated titles. This method of relevantly structuring the chess pieces is also discernible as a classic tribute to the game of chess itself, a combination that assures broad inducement for enthusiastic acceptance of said pieces as a universally appropriate, authentically relevant and impartially equable standard chess set, including the pawn as a chess piece.

The presentation of said pieces as an eminent tribute to chess would obviously be accepted by chess players recognizing the authentic association. A novice, however, will perceive said association as a visual reference determining the relevant corresponding rows of a chess board, said pieces are thus permitted to directional move along, to thereby elevate the notorious burden of learning and remembering the respective directional mobility the various chess pieces are permitted. The proficient players will also occasionally utilize said pieces as a comparatively simple and pleasant method of providing fundamental chess instruction to a novice, who in turn, would thus be encouraged to reciprocally volunteer to teach other novices using the same simplified method whereby the appreciatively expanding number of new players will also expedite the ultimate free acceptance of said pieces as a relevant, universally equable, standard chess set.

2. Description of Related Art

The dire need for a relevant chess set has inspired consistent rumors of the existence of instructive indicators incorporated within chess pieces, however, the prior art only serves to emphasize the complexities that have reduced said rumors to wishful thinking for thousands of years. The Lesavoy Patent 628,412 is a conglomerate example, whereby esthetics were abandoned in an extreme effort to be instructive. The end result basically being the head piece of a historical figure affixed on top of a prominent numerical body, trailing a diagram behind. Obviously intended as a beginners chess set (page 3, lines 57–64) and thus blatantly stigmatized it would be quickly shunned, if used at all. Thus its use is temporary and limited and its instructive value is also faulty. The numbered bodies are not visible when used as instructed on page 2, lines 60–65 and as shown in the drawings. Regardless, however, only the pawn is conventionally numbered. However, the distance a pawn may travel is improper as page 2, lines 70–72 state a pawn "in any case be moved one square". This is incorrect as chess rules permit the pawn a two square move from its original position. The statement concerning chess men on page 2, lines 93–100 is also misleading as "any No." thus permits chessmen "to at any time move any number of squares desired" this would instruct a beginner to move chessmen to pass over other chessmen if desired, in conflict with the rules of chess. Thus, Lesavoy's chessmen would create conflicting confusion for a novice due to their inaccuracies if it were intended as an internationally standard permanent chess set, as is the present invention.

The Mather's Patent 3,677,550, as well as the Epton U.S. Pat. No. Des. 195,578, have eliminated historical reference and also example the historically complex problems involved when symbolically attempting to represent the respective directional mobility of chessmen as presented in said patents. The symbols of both presentations are in a horizontal plane more suited to checkers than chessmen. The orientation of these portable chessmen to assure proper use, is totally avoided. If orientation was resolved, however, the symbols provided would still be irrelevant thus leaving the directional mobility as subject to the viewers misinterpretations.

The Mather's patent has titled FIG. 2 as a rook. A rook may move forwardly or rearwardly away from or toward the player along columns of squares; or laterally along rows of squares stated "vertically" or "horizontally". The drawing, however, shows that a two directional perpendicular move is permitted in one of four directions, a two directional move is only permitted to a knight. Thus, the bishop of FIG. 4 would better serve as a rook if so oriented. The circle of FIG.

3 is not representative of any chess move, but is rather appropriate of the frustrations encountered. The primary move of the pawn is forward, this is not shown or mentioned. Accordingly, said chessmen are irrelevant and create hardship.

The Epton patent makes no disclosure of directional mobility or orientation if it had, it would be lacking as FIG. 3 and FIG. 11 are meaningless and FIG. 5 is distorted to marginally avoid duplication of FIG. 1 they, therefore, are not relevantly functional.

U.S. Pat. Nos. Des. 204,142 and 217,479 do not disclose or claim they are more than ornamental chessmen and, therefore, like ink blots the viewer may interpret any portion of a design thereon to be imaginatively meaningful without limit. Therefore, it is specious to assume the viewer is more astute then the inventor and it is thereby conceded that speculation will not viably provide more than ornamental chessmen as stated by the inventors thereof.

SUMMARY

In accordance with the present invention structurally instructive chess pieces are provided for a game of chess played on a planar surface within a defined area divided in square position regions arranged in rows and columns, stated conventionally "ranks" and "files", the ranks being perpendicular to the files. The chess pieces are structurally relevant to the game of chess by the selective radial arrangement of projection means eminently sustained in a plane angled relative to the planar surface, which may be 90°, by discernible support means integral thereof and thus definitively indicate their respective directional mobility as instructive visual aids functionally displaying their respectively entitled directional capabilities as corresponding entities enchased as statuesque chess pieces reminiscent of regal scepters authoritatively proclaiming their respective entitlements. This authentically relevant method of structuring said pieces has thus resolved an ancient enigma, to thus provide a method that extremely simplifies the instruction of the optional directional mobility universally permitted the respective chess pieces by the authentic association of the discernible relevant structure of said pieces as definitively corresponding to the rank, file and diagonal movements on the chess board whereby said pieces thus respectively display the relevantly corresponding files, ranks and diagonals, said pieces are thus instructively entitled to directionally move along from their respective position on the chess board.

This method of geometrically structuring said pieces also provides for the intuitive proper orientation of said pieces, this is achieved by forming said pieces as two predominant opposing sides commonly sharing a predominant outline, whereby they face said outline and thereby correctly position said pieces on the chess board instinctively. The respective chess pieces thus display their entitled moves radially, the exceptional knight, however, independently displays each of its optional moves and, therefore, is initially viewed downward, as toward the viewer, from each of its prominent sides, both before and after the knight is rotated a quarter turn from its normal orientation, thus each of said views collectively present all twelve of the knight's optional moves to eight square position regions in an equably perceivable radial configuration, if so desired.

A method of providing quantitative chess instruction whereby it will not detract from the appearance or status of chess pieces may also be achieved by structural utilization of the bottom surface of said pieces to subtle locate said instruction whereby it is readily accessible when required by simply inverting said piece(s) and thus is not subject to stigmatic concatenation during the ordinary use of a chess piece, as said instruction would not be seen. The said instruction may be removable or permanent and the peripheral felt cushioning of said pieces would serve as well as complete conventional cushioning.

Accordingly, these various said methods may subtlety provide extensive or complete chess instruction by means that do not blemish the establishment of said pieces as a universally acceptable standard chess set and a relevant tribute to chess itself.

The embodiments as specifically shown and described herein are only exemplary of the inventive concepts herein disclosed and, therefore, are not intended as being limitationally implicative of the simplest or the most sophisticated of configurations that would equally serve within the scope of the concepts herein revealed. The present invention provides a method of forming relevant structurally instructive chess pieces, qualified as a standard chess set and also as simplified means of instructing the respective directional movement of the pieces in a comprehensive manner. As a heretofore unknown entity, the embodiment of said method is only limited by the imaginative selection of an endless variety of component choices. Simple configurations are, therefore, contemplated as using matched shapes, whereby color, texture, length or other means serves to discern directional indicators from support means. As an example, eight identical gem shapes in discernible tints or colors arranged about a common axis would form each of the relevant chess pieces, however, the pawns could be formed of a single gem placed in a forward setup position to indicate its primary move or could comprise a plurality of gems to also indicate its conditional optional moves. To example apposing shapes, the queen's rounded gem as shown herein separates rod shapes formed by the central facet of the directional indicators, thus, the rods may instead be fitted to a larger hub and matching base to form upright pieces, or simplified either may be positioned on a flat side of the hub, thus eliminating the need of a base orientation in this position would be determined by reference to any available or provided reference point. The more sophisticated configurations may be attained by simply combining shapes as herein exampled or shapes therebetween, whereby an infinite variety of combinations arrangements and modifications would provide a selection rivaling that of available adaptable jewelry. Therefore, it is the conceptual method of structuring said chess pieces whereby they will discernible define their respective directional mobility in actual correspondence to the relevant identically defined vertical, horizontal and diagonal rows of a chess board that primarily merits the protection hereby sought. As said method has heretofore eluded countless attempts to achieve the results herein disclosed for thousands of years, despite the acknowledged existence of the hardships that have persisted due to the absence of said method. Thus, by having been provided the method herein disclosed, the means of executing these revelations now are as variable as the international markets said pieces may serve. Thus, any suitable material and process may be used to form, define or adorn the chess pieces as herein disclosed, whereby sets of chess pieces may thus be formed of precious metals and gems, economical materials or non-tangible electronic imagery, as all are justifiable contemplated, in consideration of the prevailing circumstances.

DESCRIPTION OF THE PREFERRED EMBODIMENTS

Figure 1:
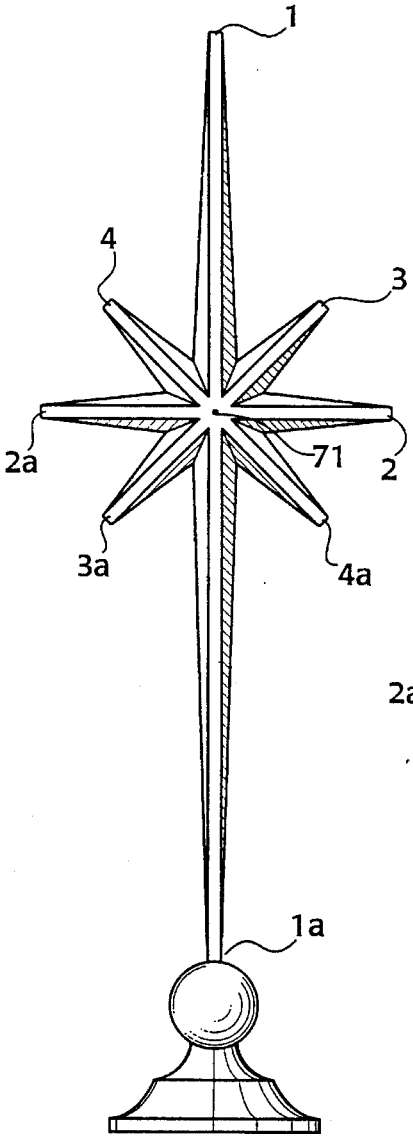
FIG. 1 is a front/rear elevation of a king.
Figure 2:
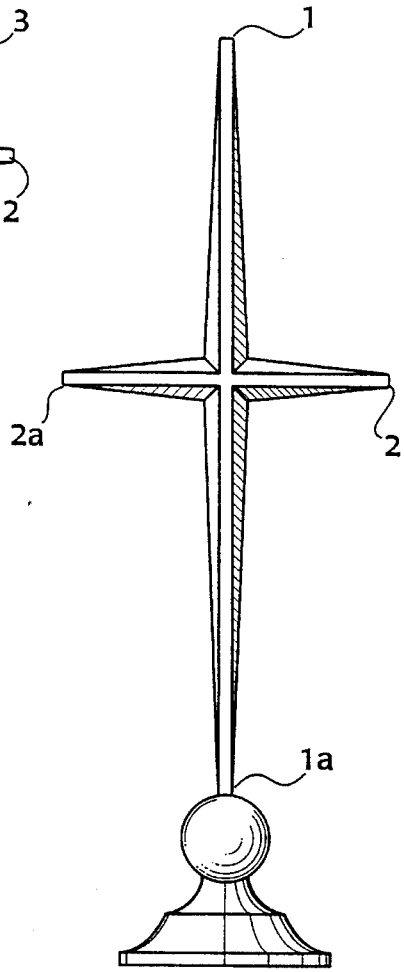
FIG. 2 is a front/rear elevation of a rook.

The chess pieces of this invention are formed with projections extending radially in a vertical plane from a horizontal axis and which indicate the direction each piece may move along the rows and columns of squares of a regulation checkered chess board; eight squares by eight squares of alternating dark and light squares. Conventionally the direction of a move away from and toward the player is a vertical move along the rows of squares, parallel with the sides of the chess board; a move laterally from side-to-side is a horizontal move.

Referring now to the drawings of this embodiment, three faceted radial projections are integrally provided the chess pieces shown in FIG. 1 through FIG. 6 as a means of structurally defining the respectively permitted directional mobility of said pieces as angularly corresponding to the defined files 9-1, ranks 9-2 and diagonals 9-3. Said pieces are thus conformingly entitled to directionally move along the relevant rows of a chess board shown in FIG. 9.

Figure 9:
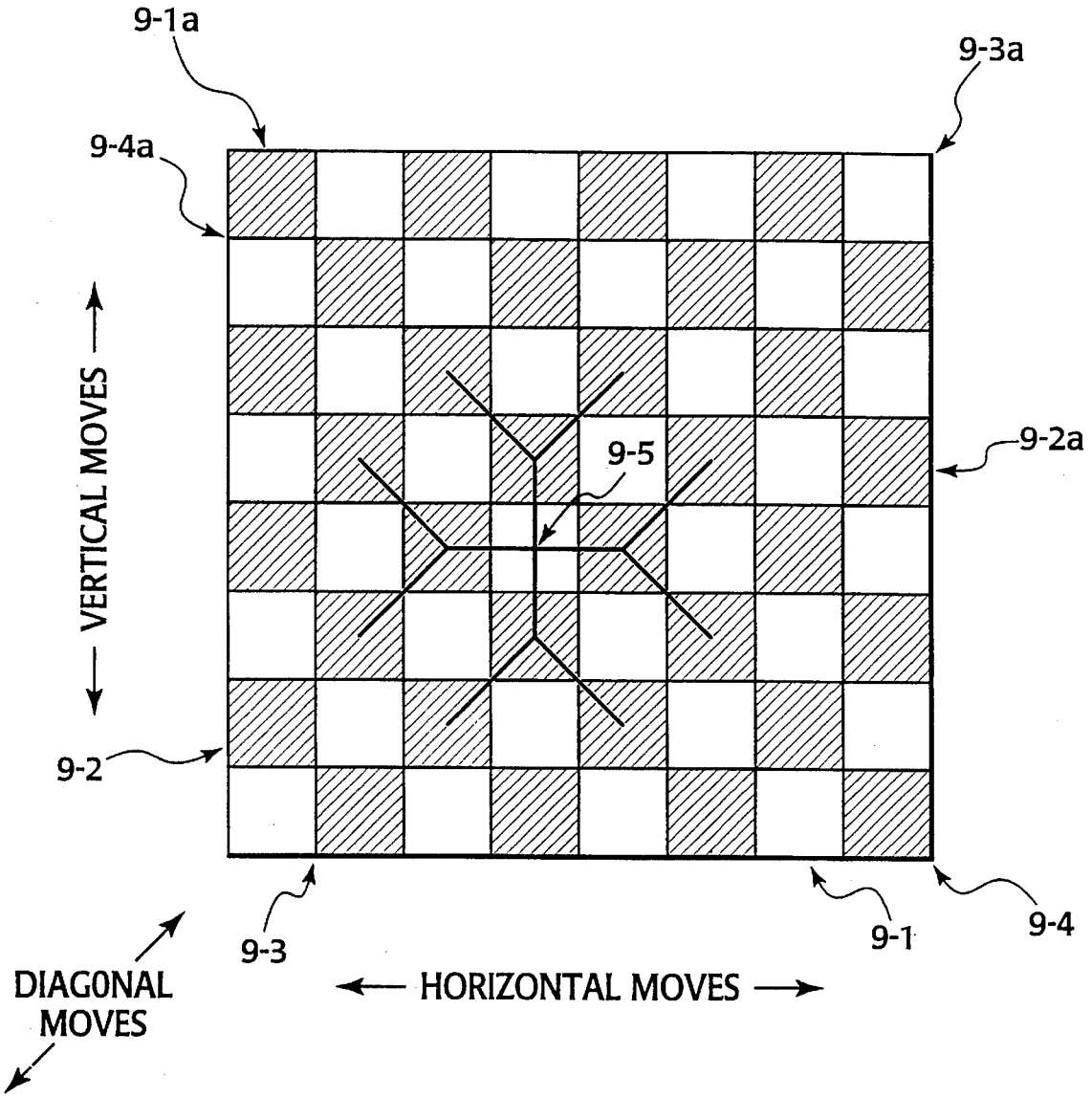
FIG. 9 is an illustration of a chess board with permissible movements indicated thereon.

Also shown in FIG. 9 are directional movements 9-5 for repositioning the knight, which requires a one square region move along a file or a rank and a one square region move diagonally. The one square region diagonal move of the knight is defined as a move from a square region in a file and rank to a square region in a next adjacent file and a next adjacent rank. It should be recognized that it is common usage with those who play chess regularly to refer to movements along a rank (or row) as horizontal movements and movements along a file 9 or column) as vertical movements. These term equivalents, file—vertical and rank—horizontal will be used interchangeably herein. However, regardless of the means of definition employed, it is the method of achieving the discernible arrangement of said projections from support means by shape, color, shades or texture, singly or in combination, that will be associatively identified with the respective chess pieces and their moves by chess players universally.

A novice, however, would require more detail concerning the exceptions to the obviously apparent radial association, regarding the complex moves of the knight and the simplistic moves of the pawn. Refer now to FIGS. 1–6, wherein like elements are assigned the same reference numerals. These figures depict three faceted structural projections radially diverging about a horizontal axis exemplified by the horizontal axis 71 of FIGS. 6 and 7, the projections being radially aligned, thus structurally project in a vertical plane. The projections are respectively angled to specifically indicate relevant directions as shown. Projections 1 and 1*a* represent vertical movement, 2 and 2*a* represent horizontal movement and projections 3 and 3*a* and 4 and 4*a*, respectively, represent diagonal movement. Structural projections indicating permissible movement direction in the embodiments shown in FIGS. 1–6 are readily distinguished from the support structure, as for example, by the two facets of the support structure and the centrally located junction lines 72, 73 and 74, respectively indicated between these two facets in FIGS. 4–6 and the lack thereof in the direction indicators. In these figures the projections of the novel chess piece each direction indicator is three faceted with junction lines that are not centrally located.

The projections, thus respectively angled structurally, indicate permissible movement along the correspondingly angled rows of a chess board, equivalently defined in FIG. 9 as: 9-1 and 9-1*a* vertical; 9-2 and 9-2*a* horizontal; 9-3 and 9-3*a* and 9-4 and 9-4*a* being respectively diagonal.

It should be recognized that the chess board pictorial shown in FIG. 9 is divided into rows of square areas 9-2, 9-2*a* and columns of square areas 9-1, 9-1*a* laid out on a planar surface. Movement along a row is described as a horizontal movement and movement along a column is described as a vertical move, while a diagonal move is a move from a square in a row and column to a square in an adjacent row and an adjacent column.

Thus, the directional indicators provided to the chess pieces shown in FIGS. 1–6, instructionally indicate the angularly relevant rows of a chess board along which the respective pieces may optionally move. Each piece is supported by a base 5 for positioning it on a chess board. For reasons of optimum clarity, the knight of FIG. 4 independently displays each of its optional moves, and thus is initially viewed downward, as a move toward the viewer, from each of its prominent sides, both before and after being rotated a quarter turn, to thus equable present all eight of the knights optional moves, as radially perceptible.

Figure 5:
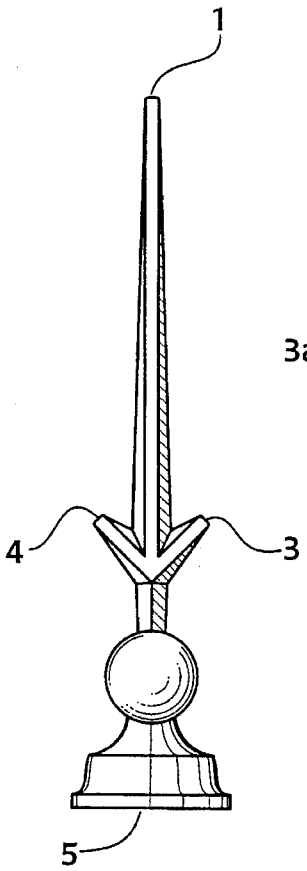
FIG. 5 is a front/rear elevation of a pawn.
Figure 6:
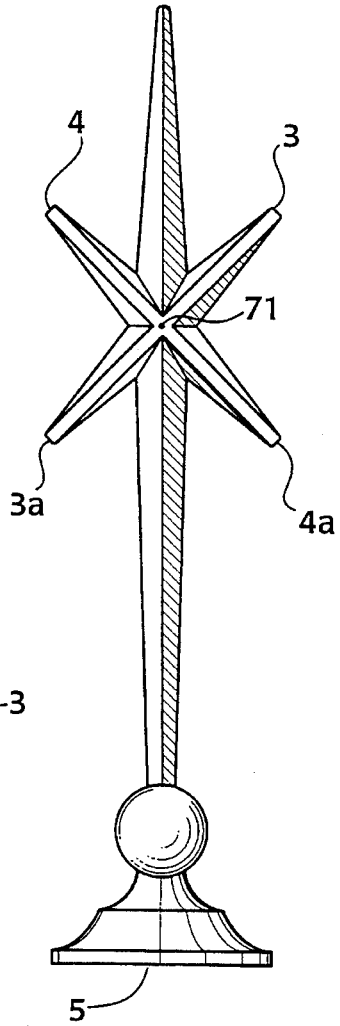
FIG. 6 is a front/rear elevation of a bishop.

The pawn of FIG. 5 primarily moves directly forward as is prominently displayed by the pawn vertical movement, however, the pawn is occasionally entitled to move diagonally forward, when it can thus displace an opponent's piece, as this option is not consistent, it is, therefore, a curtated option and thus is appropriately presented as the curtated diagonal projections of FIG. 5. Thus informed, a novice can retain the method of viewing the respective chess pieces as conformingly relative to the ranks and files of a chess board, and thus be free to absorb other aspects of the game of chess unimpeded by the formerly most difficult aspect of learning to play chess. Thus, the functional proficiency of said chess pieces has overcome the notoriously intimidating complexities inherently created by the past and present use of irrelevant chess pieces over the millenniums despite the inconceivable hardships that were collectively imposed by their incongruence.

Figure 3:
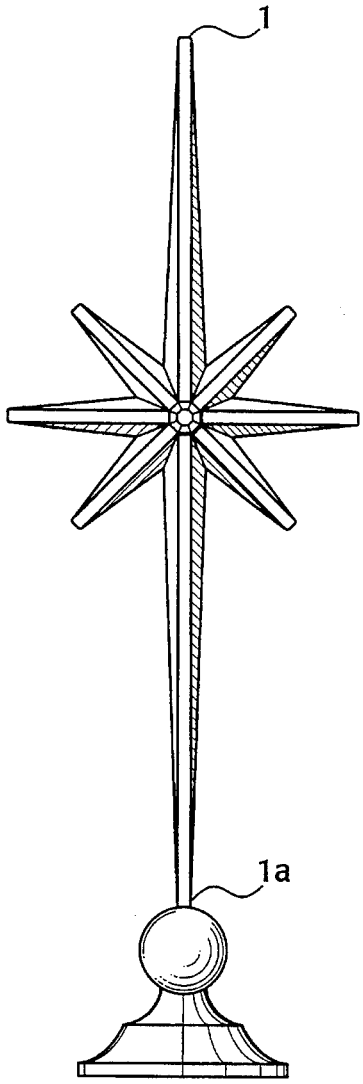
FIG. 3 is a front/rear elevation of a "jeweled" queen.
Figure 4:
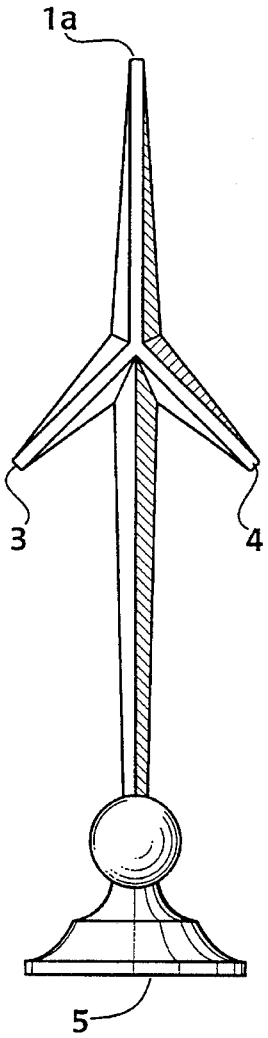
FIG. 4 is a front/rear elevation of a knight.
Figure 7:
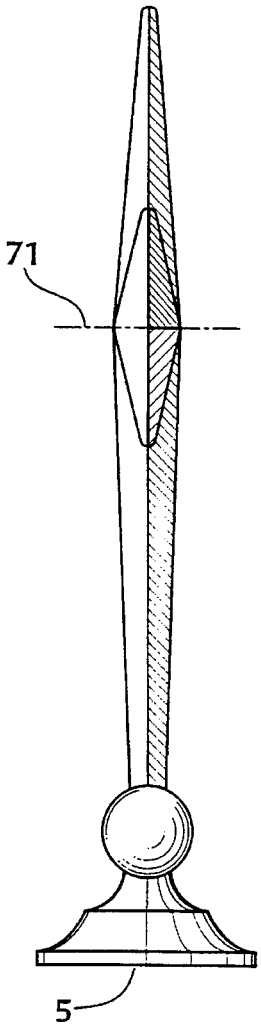
FIG. 7 is a side elevation of a bishop.

FIG. 7 exemplifies a central vertical seam that had formed the outline of FIG. 3, however, a plurality of seams are also feasible if expansion or ornamentation is desired it may also be seamless as the front and rear view of said outline will remain identical, it is not a requirement that the entire front and rear views of said piece be identical.

Figure 8:
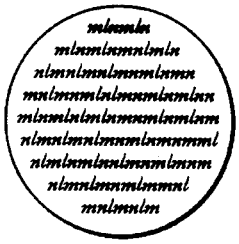
FIG. 8 is a bottom view of a chess piece having representational lines of instruction thereon.

FIG. 8 shows the bottom surface of a chess piece as circular, however, any shape may be used and eight lines of instructive copy should be readily legible thereon. For the sake of clarity, the lines of copy are shown in the figure as rows of wiggles. As it is the function of the present invention to drastically diminish the need of supplemental graphs, arrows and compensatory explanations to define the vertical, horizontal and diagonal features of said pieces and a chess board, reference arrows have been respectfully omitted as a redundant impairment of said inventions established integrity as herein presented.

I claim:

1. The combination of chess pieces and a square checkered chess board, said chess board comprising peripheral borders defined by a first player end, a second player end and two sides, eight side-by-side rows of squares extending parallel with said ends and eight side-by-side columns of squares extending parallel with said sides, each of said chess pieces comprising a base, a three-dimensional body supported by said base and extending upwardly therefrom along a vertical axis, each said body of each said chess piece being formed to constitute means for indicating all of the directions each said chess piece may be moved from one said square to others of said squares of said board when said board is horizontally oriented and said piece is located within said one said square, said indicating means comprising three-dimensional projections extending radially about a horizontal axis, at least one of said each said body being formed for indicating permissive movement in at least one of the direction toward said second player end along diagonally adjacent squares and the direction towards said first player end along diagonally adjacent squares.

2. The combination of claim 1 wherein at least one of said projections of at least one of said chess pieces extends upwardly from said axis and constitutes means indicating permissive movement of said piece along a column of squares in a direction toward said second player end, parallel with the sides of said checkered board.

3. The combination of claim 1 wherein at least one of said projections of at least one of said chess pieces extends downwardly from said axis and constitutes means indicating permissive movement of said piece along a column of squares in a direction toward said first player end, parallel with the sides of said checkered board.

4. The combination of claim 1 wherein at least one of said projections of at least one of said chess pieces extends in a horizontal plane and constitutes means indicating permissive movement of said piece along a row of squares in a direction toward a side of said board parallel with the ends of said checkered board.

5. The combination of claim 1 wherein at least one of said projections of at least one of said chess pieces extends upwardly from said axis at an acute angle to the horizontal and constitutes means indicating permissive movement of said piece in a direction toward said second player end along diagonally adjacent squares.

6. The combination of claim 1 wherein at least one of said projections of at least one of said chess pieces extends downwardly from said axis at an acute angle to the horizontal and constitutes means indicating permissive movement of said piece in a direction toward said first player end along diagonally adjacent squares.

7. The combination of claim 1 wherein each said projection has a forward face for facing said second player end of said board and an opposite facing rearward face for facing said first player end of said board, said faces being flat.

8. The combination of claim 1 wherein said chess pieces comprise king, queen, bishop, knight, castle and pawn pieces and each said body of each of said chess pieces is formed to constitute means for indicating all of the directions each said chess piece may be moved from one said square to others of said squares of said board.

* * * * *